US005367716A

United States Patent [19]

Huang

[11] Patent Number: 5,367,716

[45] Date of Patent: Nov. 29, 1994

[54] AUTOMATIC FLUSH TOILET DETERGENT AND PERFUME DISPENSER

[76] Inventor: Chi-King Huang, 7 Fl., No. 11, Ming Chuan W. Rd., Taipei, Taiwan, Prov. of China

[21] Appl. No.: 192,616

[22] Filed: Feb. 7, 1994

[51] Int. Cl.[5] ..... E03D 9/03

[52] U.S. Cl. ..... 4/222; 4/226.1; 4/228.1

[58] Field of Search ..... 4/222, 226.1, 227.1, 4/227.3, 227.4, 227.5, 227.6, 228.1

[56] References Cited

U.S. PATENT DOCUMENTS

| | | | |
|---|---|---|---|
| 1,447,289 | 3/1923 | Farnham | 4/226.1 |
| 1,643,286 | 9/1927 | Burcham | 4/226.1 |
| 3,417,410 | 12/1968 | Tietema et al. | 4/226.1 |
| 3,913,151 | 10/1975 | Keimig | 4/227.3 |
| 4,064,573 | 12/1977 | Calderone | 4/228.1 |
| 4,209,864 | 7/1980 | Lindauer | 4/222 |
| 4,625,342 | 12/1986 | Gangnath et al. | 4/222 |
| 5,125,119 | 6/1992 | Munoz | 4/228.1 |
| 5,251,340 | 10/1993 | Su-Land | 4/226.1 |
| 5,269,028 | 12/1993 | Liao | 4/222 |

FOREIGN PATENT DOCUMENTS

| | | | |
|---|---|---|---|
| 359604 | 10/1931 | United Kingdom | 4/226.1 |

*Primary Examiner*—Henry J. Recla
*Assistant Examiner*—Charles R. Eloshway
*Attorney, Agent, or Firm*—Bacon & Thomas

[57] ABSTRACT

An automatic flush toilet detergent and perfume dispenser of the type having a detergent dispensing device controlled by water pressure to send a fixed amount of a detergent into a water container being linked to the flush pipe of a toilet flushing system, and a DC motor fan operated perfume dispensing device controlled to spray a liquid perfume into the air, the improvement including two full water level detector probes detect water level and to give a signal when water in the water container reaches full water level, a buzzer, light emitting devices, a control circuit controlled by the signal from the full water level detector probes to turn on the DC motor fan, the buzzer, and the light emitting devices, and a manual control switch controlled to trigger the control circuit manually.

2 Claims, 12 Drawing Sheets

AUTOMATIC FLUSH TOILET DETERGENT AND PERFUME DISPENSER

BACKGROUND OF THE INVENTION

The present invention relates to an automatic flush toilet detergent and perfume dispenser which sends a fixed amount of a detergent into the flush toilet and sprays a liquid perfume into the air each time the flushing system is operated.

The techniques of mounting a chemical dispensing device on the toilet to send a detergent into the toilet upon each use of the lavatory, have been known and described in U.S. Pat. Nos. 1,447,289; 1,643,286, 3,417,410; 3,913,151.

According to U.S. Pat. 1447289, a water container is provided to take water from the flush pipe of a toilet flushing system, having a float on the inside. The floats opens a valve to let a soluble perfume enter the water container, when water in the water container reaches full water level. Because the perfume is immediately carried away and disappears in the sewerage system, little smell of the perfume is distributed into the air.

According: to U.S. Pat. No. 1,643,286, a detergent container is disposed inside a water container, and a linkage is installed in the exhaust valve of the detergent and water containers for controlling the output of the detergent from the detergent container :into the water flushing system by means of the control of water pressure. This structure of the detergent dispensing device is bulky and produces noises during its operation. Another drawback of this structure of detergent dispensing: device is that it does not fit all types of toilets.

According to U.S. Pat. No. 3,417,410, a detergent container is provided, having a guide tube to guide flushing water from the flush pipe into the detergent container for mixing with the detergent, and a drain tube for guiding mixed detergent solution out of the detergent container into the flush pipe again.

According: to U.S. Pat. No. 3,913,151, a detergent container is received inside a water container. The detergent container has a drain port at the bottom mounted with two control valves. When the water container is empty, the control valves drop to stop the outlet of the detergent dispensing chamber. When water in the water container is increasing, the first control valve will be lifted by a float to close the drain port. When water in the water container is continuously increasing, the second control valve will be lifted to open the outlet of the detergent dispensing chamber for letting the detergent being prepared in the detergent dispensing chamber driven out of the detergent dispensing chamber into the water container.

The aforesaid structures do not provide any function for allowing the user to check the existing amount of the detergent (perfume) in the detergent (perfume) container visually. Furthermore, they do not spray any perfume into the air but simply send a soluble perfume, if any, into flushing water. Therefore, these devices do not provide the function of purifying the air.

SUMMARY OF THE INVENTION

The present invention has been accomplished to provide an automatic flush toilet detergent and perfume dispenser which eliminates the aforesaid drawbacks. According to one aspect of the present invention, the automatic flush toilet detergent and perfume dispenser comprises a detergent dispensing device controlled by water pressure to send a fixed amount of a detergent into a water container being linked to the flush pipe of a toilet flushing system, and a DC motor fan operated perfume dispensing device controlled to spray a liquid perfume into the air. According to another aspect of the present invention, the housing of the automatic flush toilet detergent and perfume dispenser has a view window for allowing the user to check the existing amount of the detergent in the detergent container and the perfume in the perfume container. According to still another aspect of the present invention, the automatic flush toilet detergent and perfume dispenser further comprises two full water level detector probes to detect water level in the water container and to give a signal when water in the water container reaches full water level, a buzzer, light emitting devices, a control circuit controlled by the signal from the full water level detector probes to turn on the DC motor fan, the buzzer, and the light emitting means. According to still another aspect of the present invention, a manual control switch is provided and controlled to trigger the control circuit manually for checking the operation of the automatic flush toilet detergent and perfume dispenser.

DETAILED DESCRIPTION OF THE PREFERRED EMBODIMENT

Figure 1:
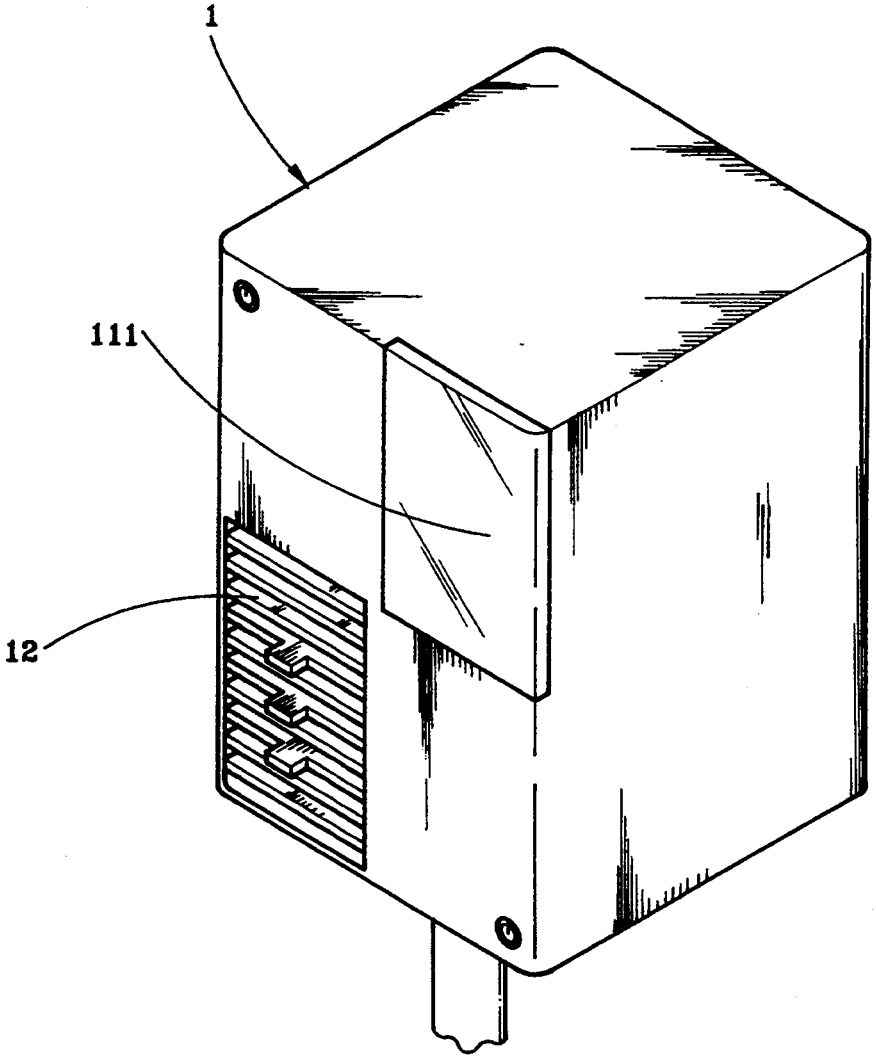
FIG. 1 is an elevational view of an automatic flush toilet detergent and perfume dispenser according to the preferred embodiment of the present invention.

Referring to FIG. 1, the automatic flush toilet detergent and perfume dispenser comprises a housing 1 having a view window 111 on the front panel thereof at one corner, through which the internal arrangement of the dispenser is viewed, and a shutter 12 on the front panel at another corner, through which a perfume is sent out.

Figure 2:
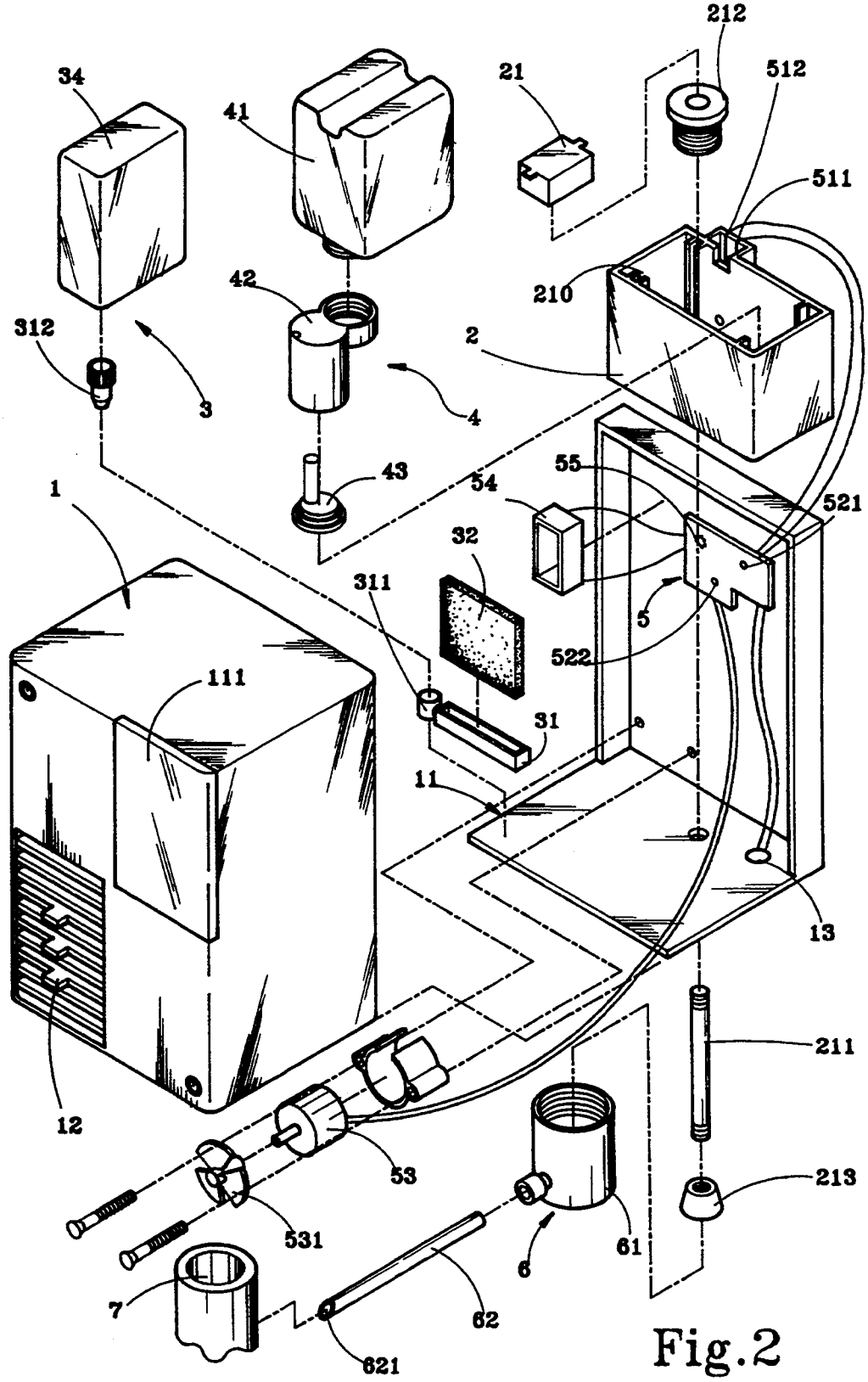
FIG. 2 is an exploded view of the automatic flush toilet detergent and perfume dispenser shown in FIG. 1.
Figure 3:
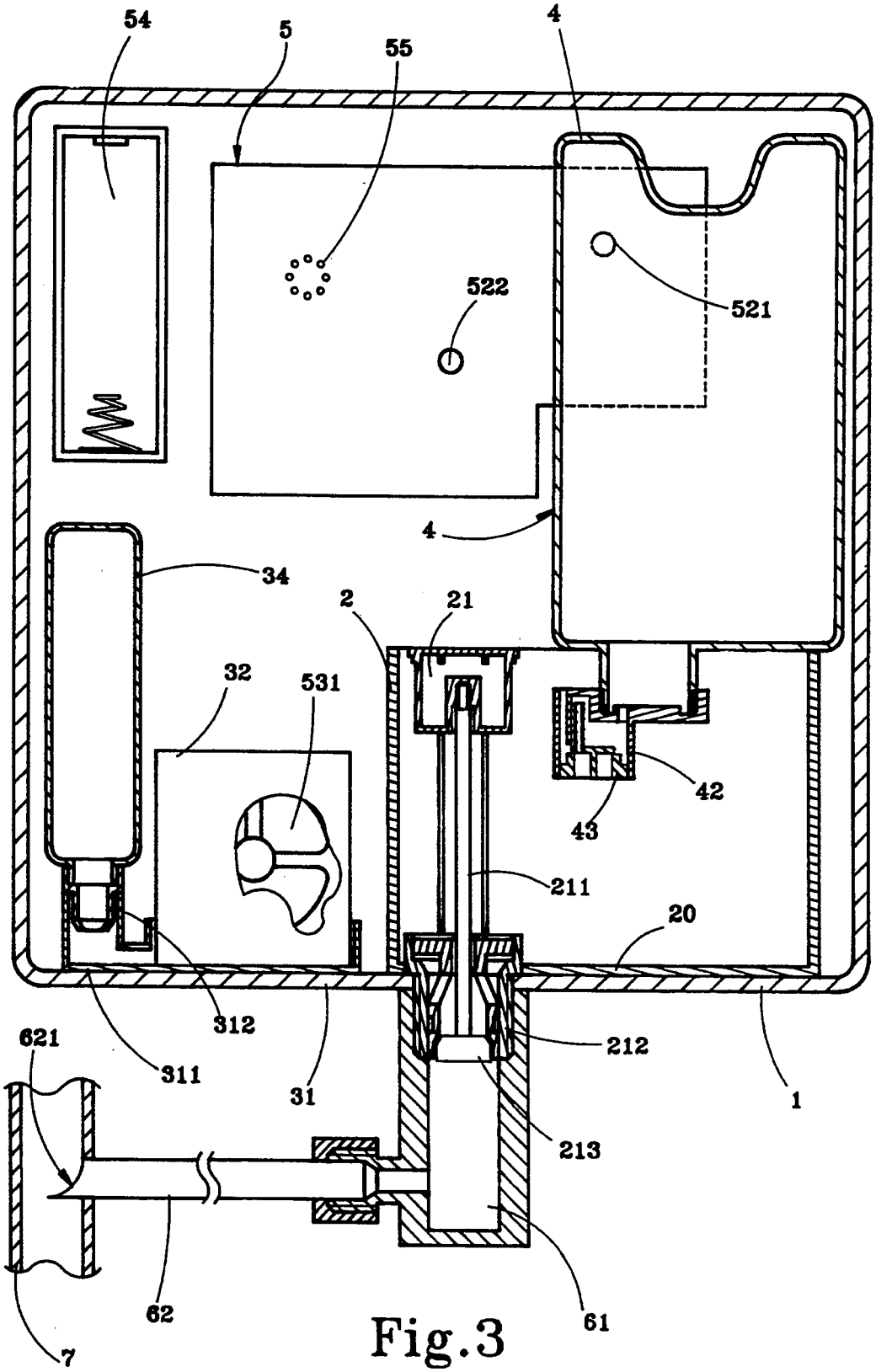
FIG. 3 is a sectional view showing the internal arrangement of the automatic flush toilet detergent and perfume dispenser shown in FIG. 1.

Referring to FIGS. 2 and 3, a top-open water container 2 is mounted on the horizontal wall of an angle base plate 11 inside the housing 1, The water container 2 comprises a valve seat 212 on the bottom 20 thereof for passing water. A water guide device 6 is provided to guide flushing water into the water container 2. The water guide comprises a guide pipe 62 connected to the valve seat 212 by a pipe connector 61. The water guide pipe 62 has a beveled front end 621 inserted into a hole (not shown) on the flush pipe 7 of a flushing system for guiding water from the flushing system into the water container 2. A float 21 is disposed in a vertical track 210 inside the water container 2 and mounted on an upright rod 211 at the top. The bottom end of the upright rod 211 is coupled with a valve cone 213. The valve cone 213 is received inside the pipe connector 61 and moved to control the passage of the valve seat 212. A detergent dispensing device 4 is fastened inside the housing 1 and disposed above the water container 1. When water is guided into the water container 2, the detergent dispensing device 4 will send out a fixed amount of the detergent being contained therein to mix with water in the water container 2, and then the detergent solution will be drawn away from the water container 2 into the flush pipe 7 again. The detergent dispensing device 4 comprises a transparent detergent container 41, which holds a detergent (such as quaternary ammonium compound) and has a bottom opening 410 (see FIG. 7), a dispensing cap 42 fastened to the bottom opening 410 of the transparent detergent container 41 and disposed inside the water container 2 at the top, and a dispensing valve 43 fastened to the dispensing cap 42 and moved by water to control the passage through the bottom opening 410.

Figure 7:
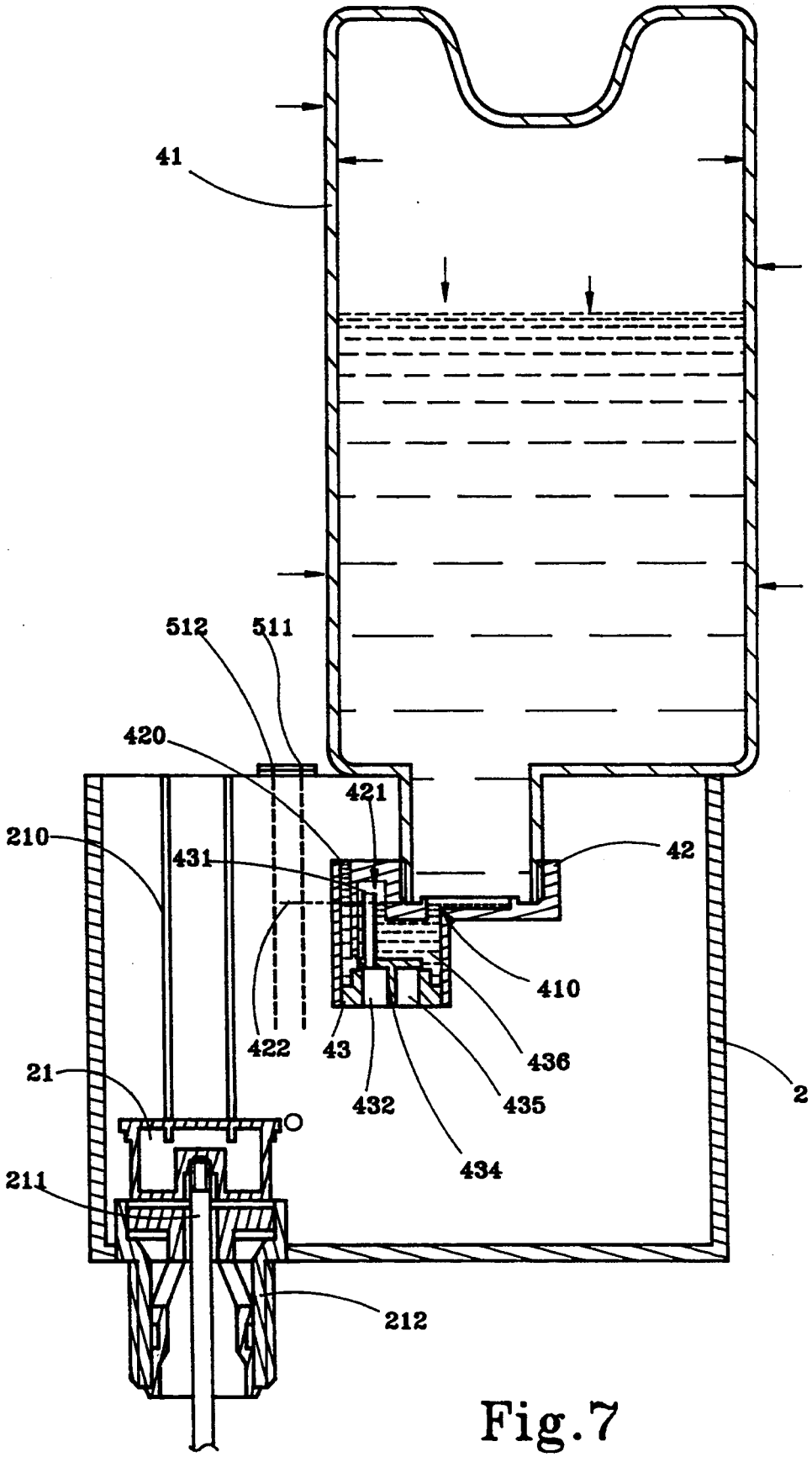
FIG. 7 is a cross sectional view showing the internal structure of the detergent dispensing device and water container of the automatic flush toilet detergent and perfume dispenser shown in FIG. 1.

Referring to FIG. 7, when the water container 2 contains; no water, only a small amount of the detergent flows out of the transparent detergent container 41 into a preservation chamber 436 inside the dispensing cap 42. The preservation chamber 436 is disposed in communication with the atmosphere by a small through hole 420 on the dispensing cap 42 and a water intake hole 431 on the dispensing valve 43. At this moment, the gravity of the detergent in the transparent detergent container 41 is balanced with the atmosphere pressure, and therefore the detergent is prohibited from flowing out of the detergent container 41 further.

Figure 8:
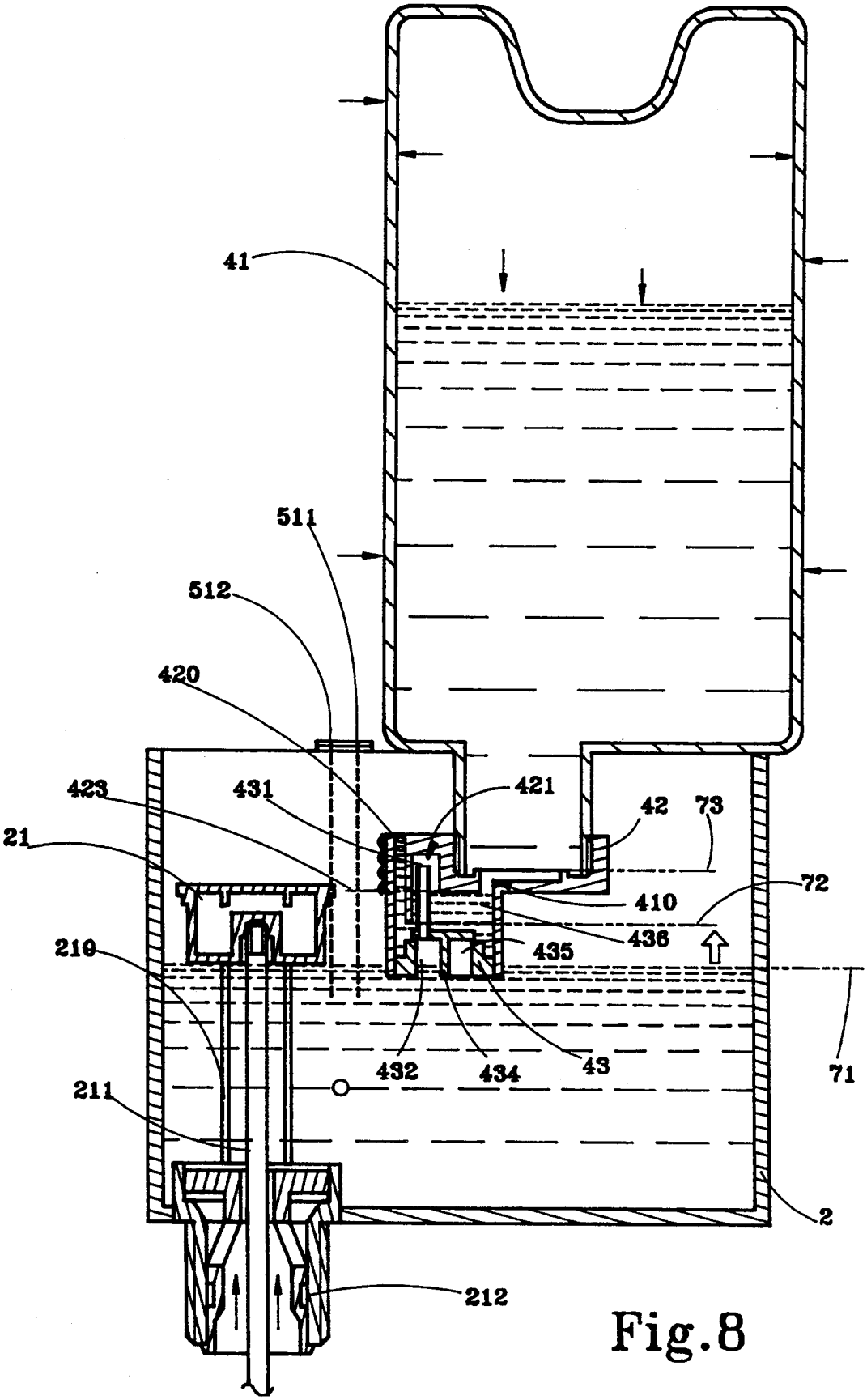
FIG. 8 is similar to FIG. 7 but showing water guided into the water container.

Referring to FIG. 8, when water level rises and touches the bottom of the dispensing valve 43, air in the first air chamber 421 (on the dispensing cap 42) and the second air chamber 432 (on the dispensing valve 43) is forced to compress the preservation chamber 436 causing the detergent in the preservation chamber 436 to drop from elevation 422 to elevation 423, and therefore an equal amount of the detergent is forced to flow out of the dispensing cap 42 through the through hole 420 into the water container 2 for mixing with water. When a fixed amount of the detergent is driven out of the dispensing cap 42, an equal amount of air is forced to flow from the first and second air chambers 421, 432 into the detergent container 41. When water level keeps moving to elevation 71, then elevation 72, and then elevation 73, more air is forced into the detergent container. Under this stage, the pressure inside the detergent container is still smaller than the atmosphere pressure, and therefore the detergent does not flow out of the detergent container 41.

Figure 9:
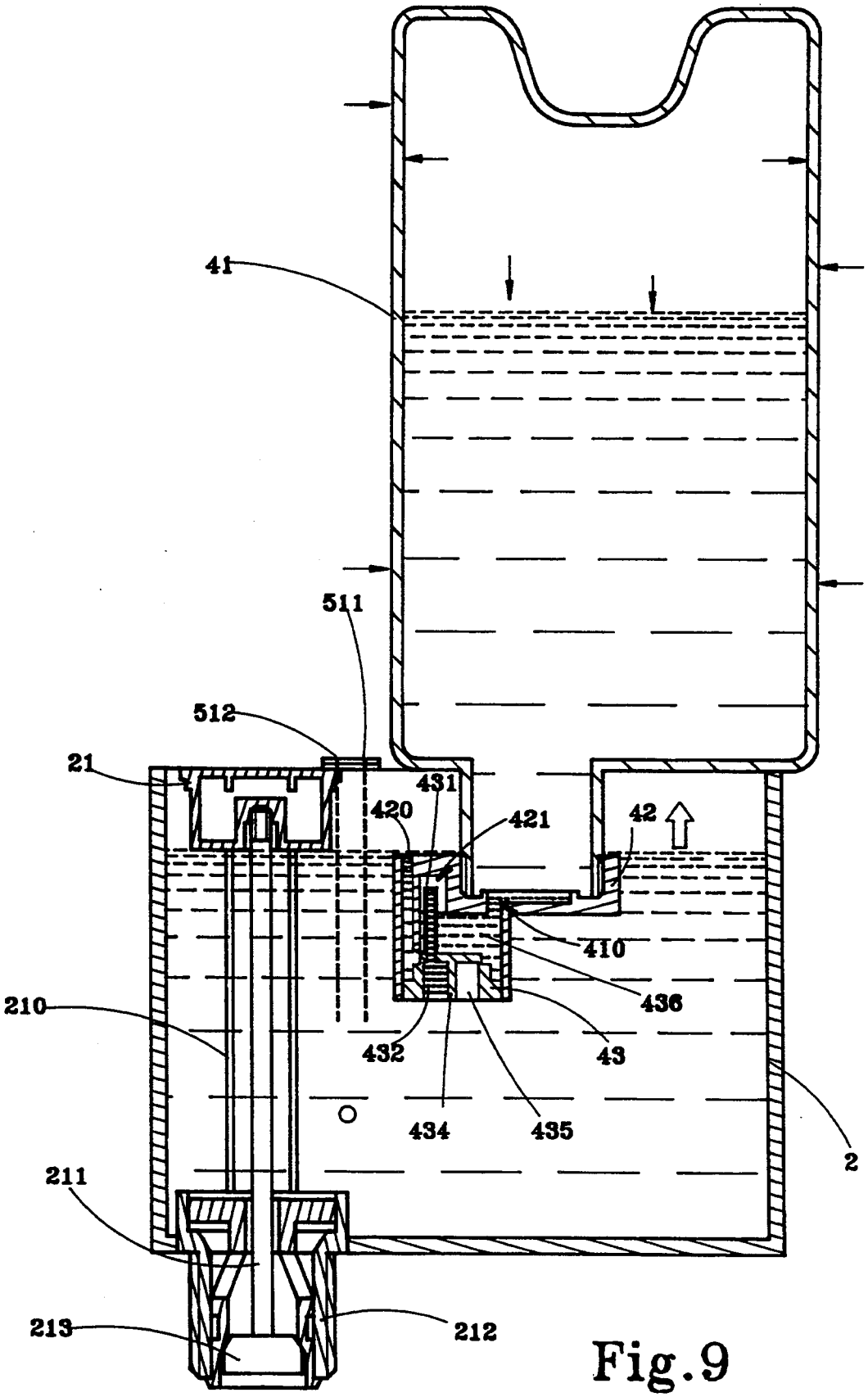
FIG. 9 is similar to FIG. 8 but showing water level moved to the elevation above the dispensing cap.

Referring to FIG. 9, when water level surpasses the water intake hole 431, water flows from the water container 2 into the preservation chamber 436 to mix with the detergent being retained in the preservation chamber 436 and then continuously flows out of the dispensing cap 42 through the through hole 420 into the water container 2 again. Therefore, what is contained in the water container 2 in this stage is a detergent solution.

Figure 10:
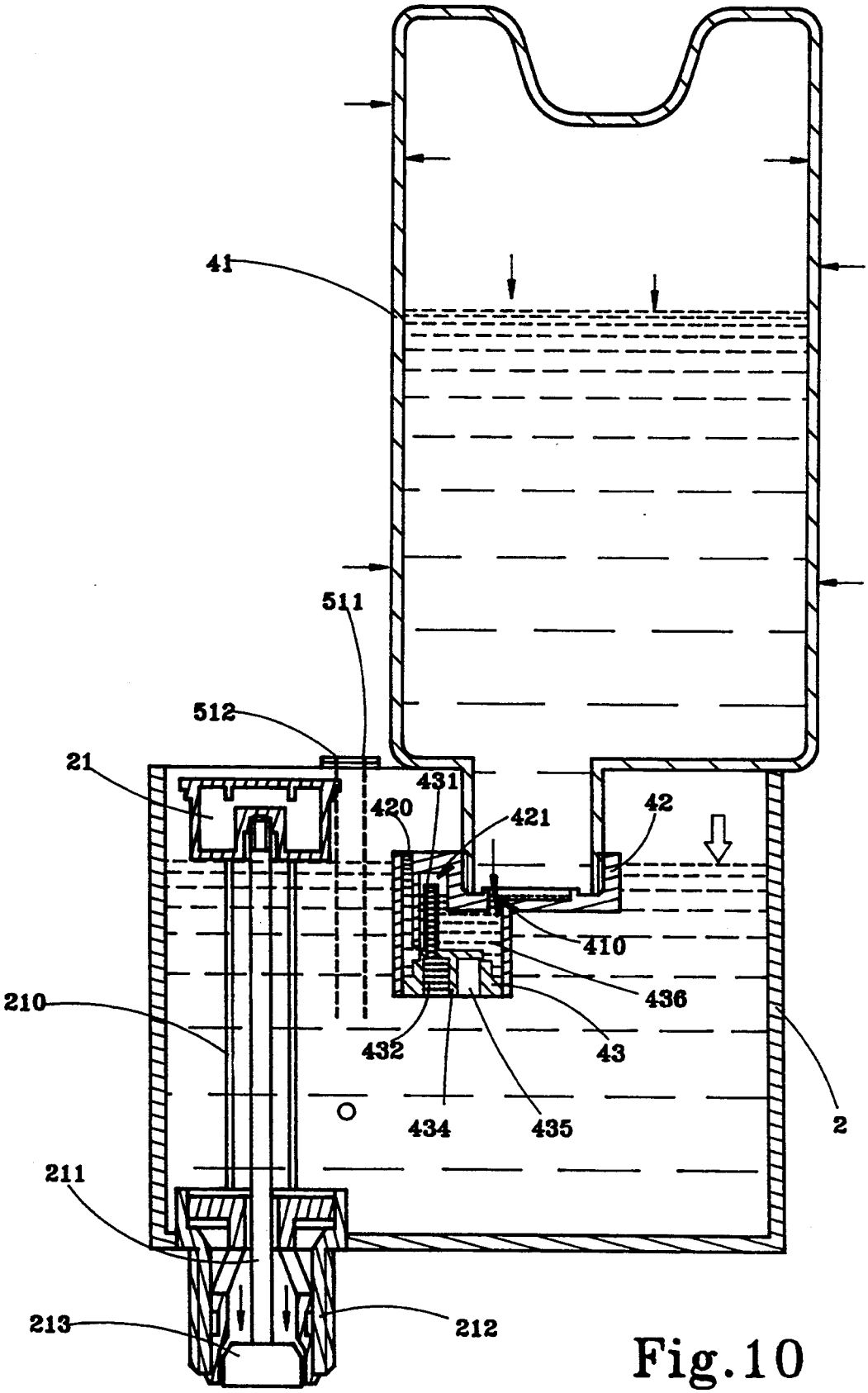
FIG. 10 is similar to FIG. 9 but showing water level being dropped.
Figure 11:
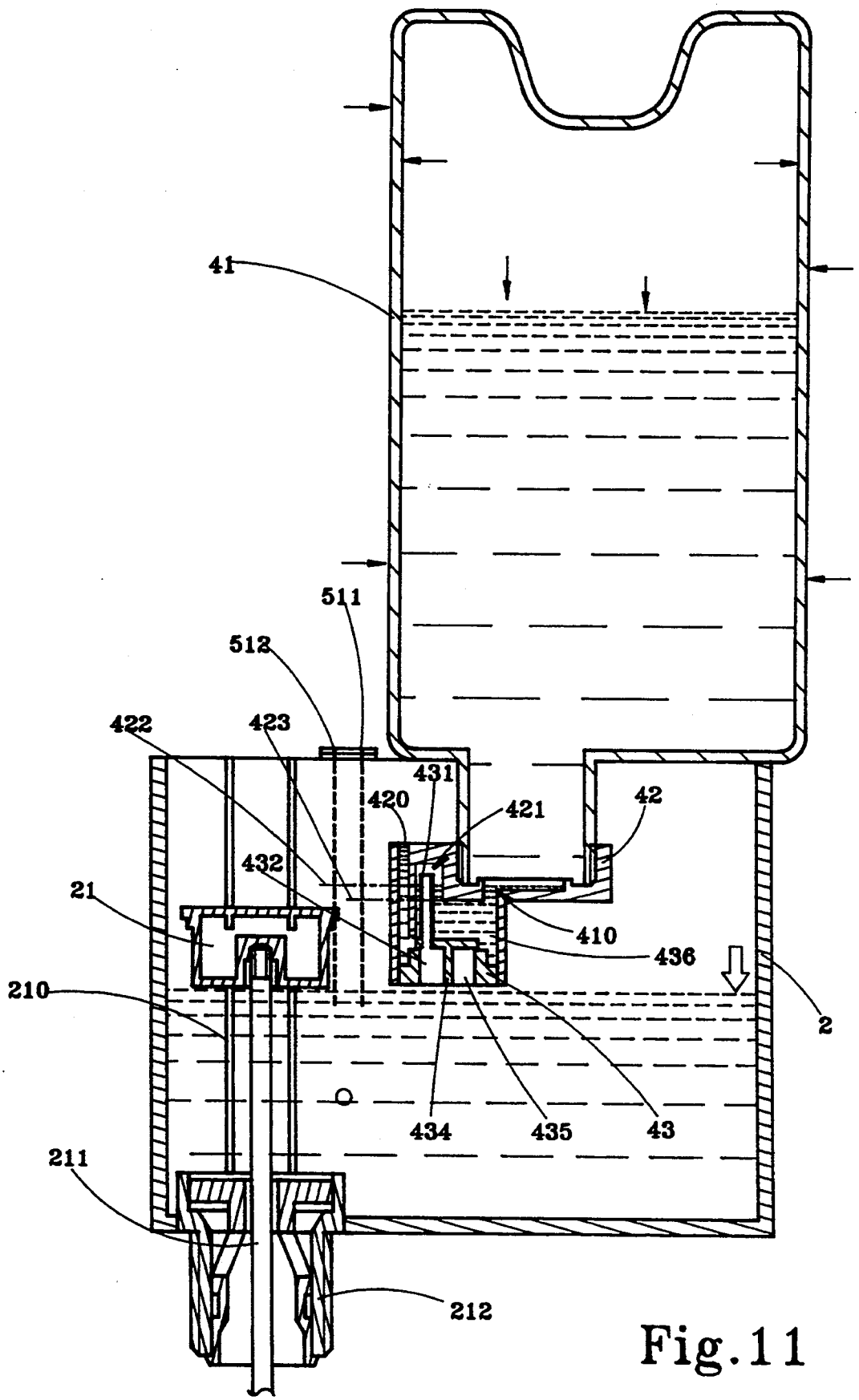
FIG. 11 is similar to FIG. 10 but showing dropped to the elevation below the bottom of the dispensing cap.

Referring to FIG. 10, when water flows back from the water container 2 into the flush pipe 7, the pressure in the detergent container 41 is relatively released, causing a fixed amount of the detergent squeezed out of the detergent container 41 through the bottom opening 410 into the preservation chamber 436. When a fixed amount of the detergent is squeezed out of the detergent container 41 into the preservation chamber 436, the residual detergent solution in the preservation chamber 436 is moved out of the dispensing cap 42 through the through hole 420 into the water container 2. When water level in the water container 2 drops below the elevation of the bottom of the detergent dispensing device 4, air is allowed to enter the first and second air chambers 421, 432 again, and therefore the dispensing valve 43 and the dispensing cap 42 are returned to the conditions shown in FIG. 7.

Referring to FIGS. 2 and 3 again, two (positive and negative) probes 511, 512 are fastened to the water container 2 to detect water level. When water in the water container 2 reaches full water level, the water level detecting probes 511, 512 inmediately trigger a control circuit 5 causing it to turn on two light emitting devices (for example:LED) 521, 522, a buzzer 55, and a DC motor 53. When the DC motor 53 is turned on, the fan 531 which is mounted on the output shaft of the DC motor 53 is driven to send a current of air toward a perfume carrier 3 causing a perfume to be spread into the air. The perfume carrier 3 comprises a sponge holder 31 mounted on the angle base frame 11, a sponge 32 carried on the sponge holder 31 and having a guide hole 311, a perfume bottle 34, a connector 312 connected between the perfume bottle 34 and the guide hole 311 for guiding a liquid perfume from the perfume bottle 34 into the sponge holder 31. Therefore, the sponge 32 frequently sucks in the liquid perfume from the sponge holder 31 while the fan 531 sends a current of air toward the sponge 32. Power supply for the control circuit 5, the light emitting devices 521, 522 and the motor 53, is provided from a battery box 54. The battery box 54 and the control circuit 5 as well as the DC motor 53 are mounted on the vertical wall of the angle base frame 11.

Figure 4:
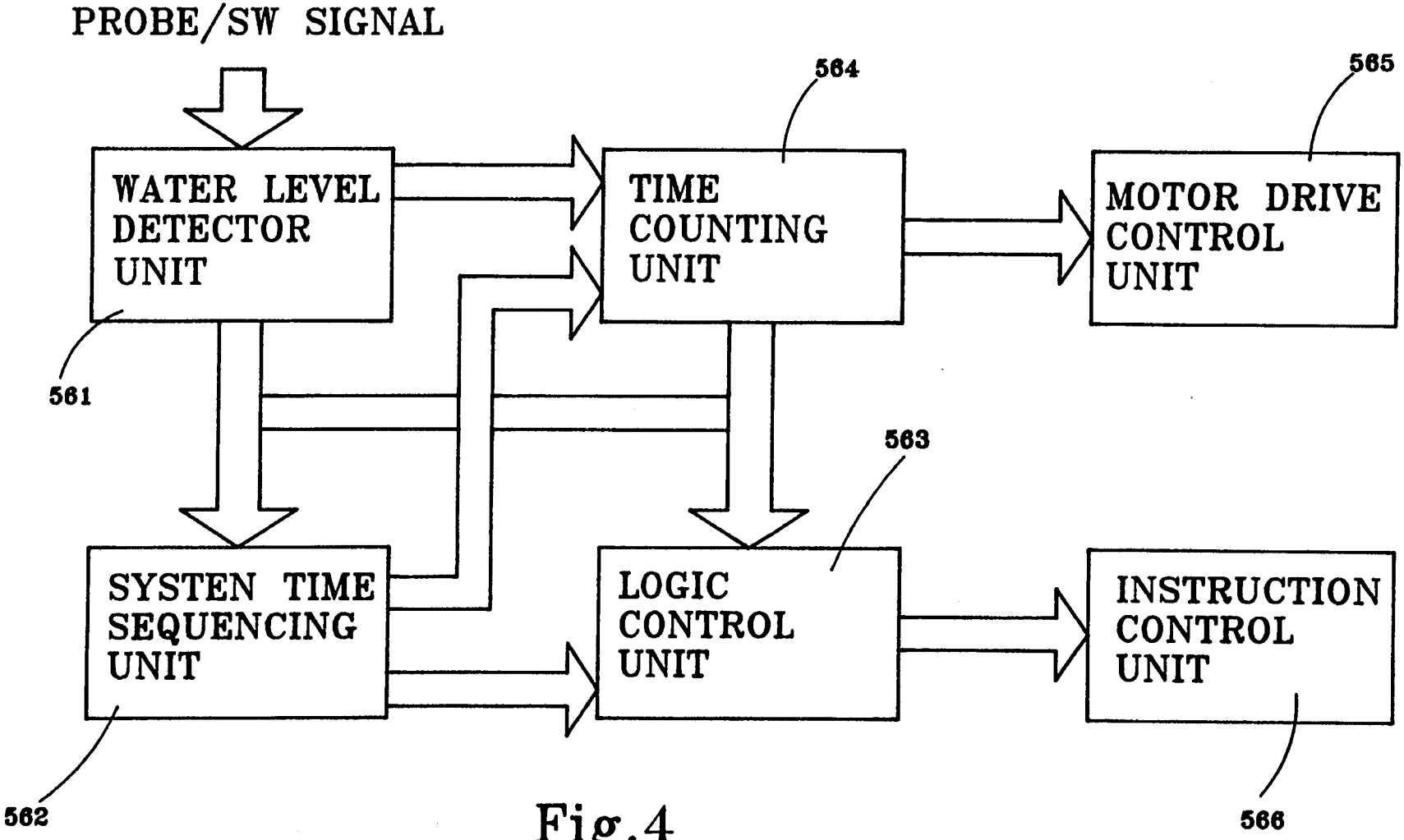
FIG. 4 is a block diagram of the control circuit of the present invention.
Figure 4A:
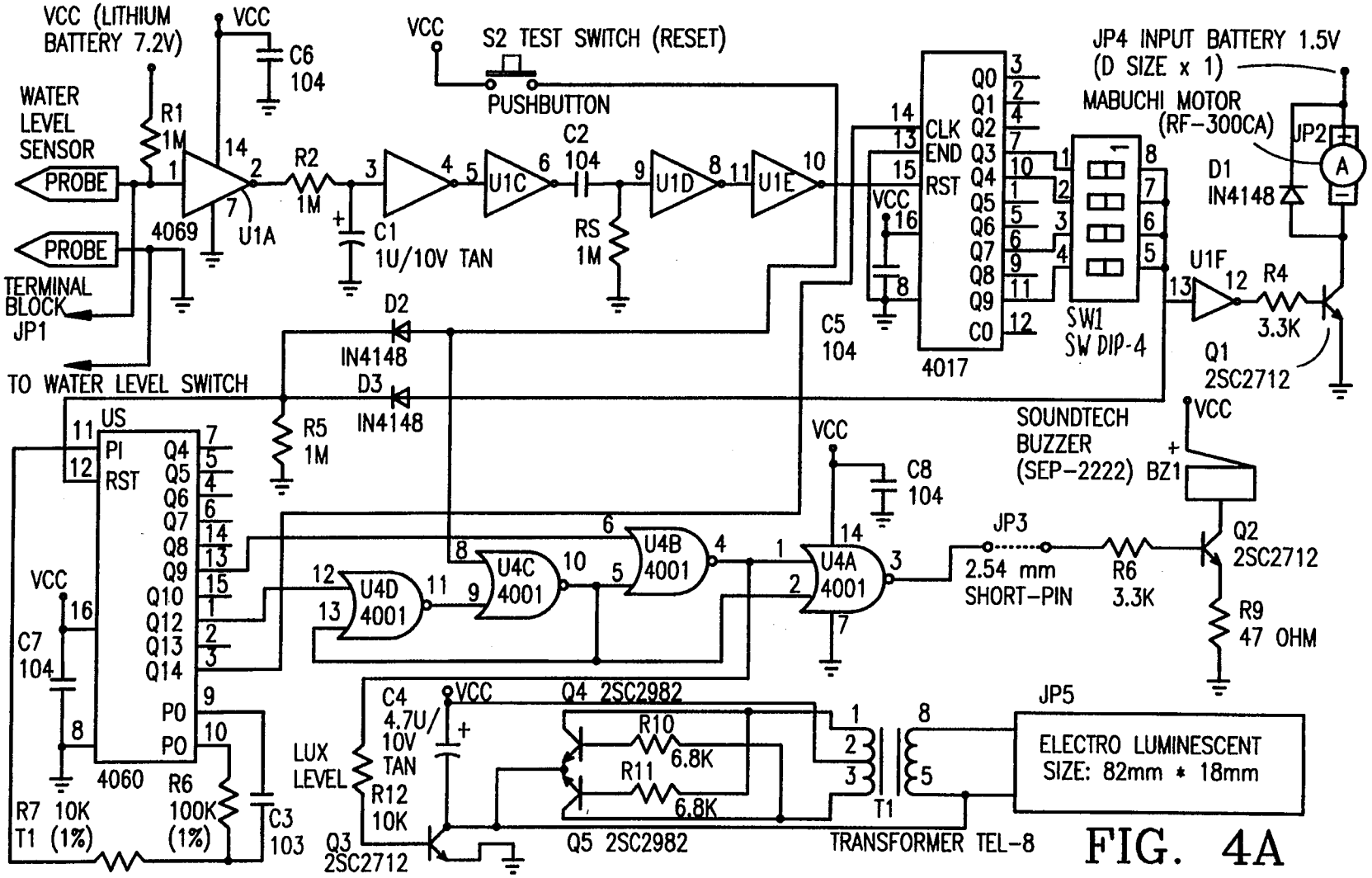
FIG. 4A is a detailed circuit diagram of the invention.
Figure 5:
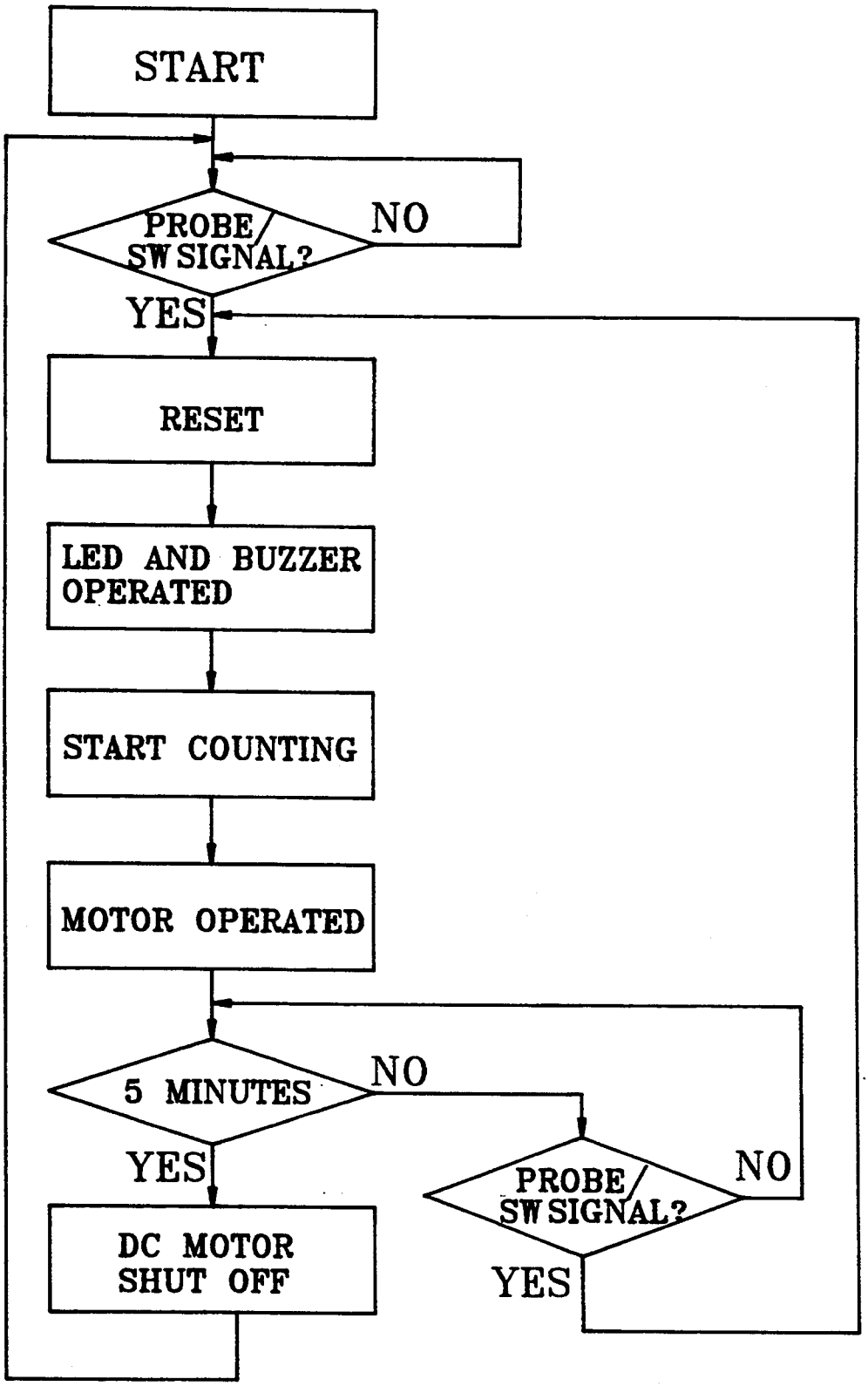
FIG. 5 is an operational flow chart of the present invention.

Referring to FIGS. 4 and 5, the control circuit 5 comprises a water level detector unit 561, a system time sequencing unit 562, a logic control unit 563, a time counting unit 564, a motor drive control unit 565, and an instruction control unit 566. The water level detector unit 561 is controlled by the probes 511, 512 to send a signal to the system time sequencing unit 562. During the test of the system, the water level detector unit 561 can be driven to give a signal to the system time sequencing unit 562 by means of the control of a press button switch 13, which is mounted on the angle base frame 11 at the bottom and extended to the outside of the housing 1 (see FIG. 2). When triggered, the control circuit 5 is caused to reset, and the system time sequencing unit 562 immediately sends a signal to the time counting unit 564 and the logic control unit 563. Upon receipt of the signal from the system time sequencing unit 562, the time counting unit 564 tuns on the DC motor 53 and starts count time, and at the same time, the logic control unit 563 gives an instruction to turn on the light emitting devices 521, 522 and the buzzers 55 for a predetermined length of time. When time is up (for example: 5 minutes after counting), the time counting unit 564 stops from counting, and the DC motor 53 is stopped, and therefore the system returns to the reset mode for next operation.

Figure 6:
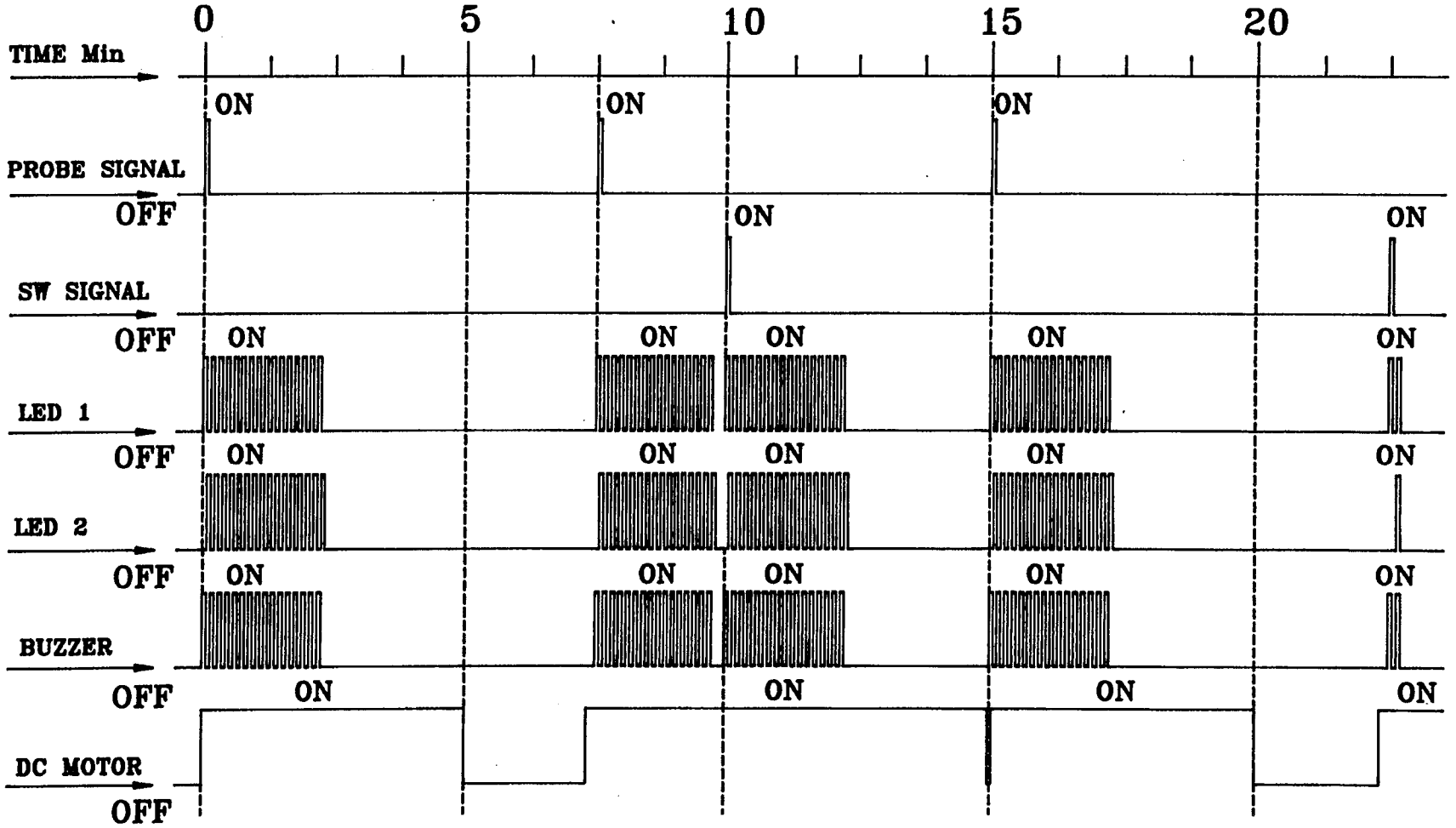
FIG. 6 is a time sequencing chart showing the operation of the present invention.

Referring to FIG. 6, therein shown is the time sequencing chart of the control circuit 5. When the water level detector unit 561 is started, the light emitting devices 521, 522 are triggered to flash alternatively, the buzzer 55 is triggered to give an audible signal, and the DC motor 53 is driven to operate for 5 minutes.

I claim:

1. In an automatic flush toilet detergent and per fume dispenser comprising:

a housing having a view window and an exhaust port with a shutter on a front panel thereof:

a water container mounted inside said housing at a bottom thereof, said water container comprising a valve seat at a bottom thereof, a float floatable in water in said water container, an to upright rod having a top end connected to said float and a bottom end extending out of said valve seat and coupled with a valve cone said valve cone being moved by said float via said rod to control opening of said valve, seat;

a water guide to guide water from a flush pipe associated with toilet flushing system into said water container through said valve seat;

a detergent dispensing device disposed inside said housing above said water container, said detergent dispensing device comprising a transparent detergent container having a bottom opening, a dispensing cap fastened to the bottom opening on said detergent container and adopted to dispense a fixed amount of a detergent from said transparent detergent container into said water container when water in said water container reaches full water level;

a perfume dispensing device mounted inside said housing behind said shutter, said perfume dispensing device comprising a sponge holder having a guide hole, a perfume bottle having a bottom hole connected to the guide hole on said sponge holder, a sponge mounted on said sponge holder to suck in a liquid perfume being guided from said perfume bottle into the guide hole of said sponge holder, and a DC motor fan driven to send a current of air through said sponge toward said shutter;

the improvement comprising:

two full water level detector probes fastened to said water container to detect water level and to give a signal when water in said water container reaches full water level;

a buzzer;

light emitting means;

a control circuit controlled by the signal from said full water level detector probes to turn on said DC motor fan, said buzzer, and said light emitting means; and a manual control switch mounted on said housing and controlled to trigger said control circuit manually.

2. The improvement of claim 1 wherein said control circuit comprises a water level detector unit control led by said full water level detector probes and said manual control switch, a system time sequencing unit, a motor drive control unit, and an instruction control unit; when said water level detector unit is triggered by said full water level probes or said manual control switch, said control circuit is caused to reset, and said system time sequencing unit immediately sends a signal to said time counting unit and said logic control unit, causing said motor drive control unit driven by said time counting unit to turn on said DC motor fan for a predetermined length of time, and simultaneously causing said instruction control unit driven by said logic control unit to turn on said light emitting means and said buzzer.

* * * * *